US011299799B2

(12) United States Patent
Kang et al.

(10) Patent No.: US 11,299,799 B2
(45) Date of Patent: Apr. 12, 2022

(54) AUSTENITIC STAINLESS STEEL PRODUCT HAVING EXCELLENT SURFACE PROPERTIES AND MANUFACTURING METHOD OF THE SAME

(71) Applicant: POSCO, Pohang-si (KR)

(72) Inventors: Hyung Gu Kang, Pohang-si (KR); Jae-Hong Shim, Seoul (KR); Gyu Jin Jo, Pohang-si (KR); Dong Chul Chae, Pohang-si (KR)

(73) Assignee: POSCO, Pohang-si (KR)

( * ) Notice: Subject to any disclaimer, the term of this patent is extended or adjusted under 35 U.S.C. 154(b) by 215 days.

(21) Appl. No.: 16/472,973

(22) PCT Filed: Dec. 4, 2017

(86) PCT No.: PCT/KR2017/014086
§ 371 (c)(1),
(2) Date: Jun. 24, 2019

(87) PCT Pub. No.: WO2018/117480
PCT Pub. Date: Jun. 28, 2018

(65) Prior Publication Data

US 2020/0190643 A1 Jun. 18, 2020

(30) Foreign Application Priority Data

Dec. 23, 2016 (KR) ..... 10-2016-0177373

(51) Int. Cl.

| | |
|---|---|
| ***C22C 38/44*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/16*** | (2006.01) |

(52) U.S. Cl.
CPC ..... *C22C 38/44* (2013.01); *C21D 8/0205* (2013.01); *C21D 8/0226* (2013.01);
(Continued)

(58) Field of Classification Search
CPC ..... C21D 1/18; C21D 2211/001; C21D 2211/008; C21D 6/004; C21D 8/0205; C22C 38/00
(Continued)

(56) References Cited

U.S. PATENT DOCUMENTS

2003/0099567 A1* 5/2003 Suzuki ..... C22C 38/04 420/80
2005/0241737 A1* 11/2005 Ujiro ..... C22C 38/18 148/650
2020/0087752 A1* 3/2020 Kang ..... C21D 8/0226

FOREIGN PATENT DOCUMENTS

EP 0594865 A1 11/1993
EP 1156125 A2 11/2001
(Continued)

OTHER PUBLICATIONS

NPL: on-line translation of JP-07292438A, Nov. 1995 (Year: 1995).*
(Continued)

*Primary Examiner* — Jie Yang
(74) *Attorney, Agent, or Firm* — Morgan, Lewis & Bockius LLP

(57) ABSTRACT

An austenitic stainless steel product having excellent surface characteristics and a manufacturing method therefor are disclosed. The disclosed austenitic stainless steel product comprises an austenitic stainless steel comprising, by weight percent, 0.005 to 0.15% of C, 0.1 to 1.0% of Si, 0.1 to 2.0% of Mn, 6.0 to 8.0% of Ni, 16 to 18% of Cr, 0.1 to 4.0% of Cu, 0.005 to 0.2% of N, 0.01 to 0.2% of Mo, and the remainder comprising iron (Fe) and other unavoidable impurities, and a Ni surface negative segregation thereof defined by the following formula (1) is 0.6 to 0.9 and the martensite fraction thereof is 10 to 30%.

$$(C_{Ni\text{-}Min})/(C_{Ni\text{-}Ave}) \quad \text{formula (1)}$$

(Continued)

Here, $C_{Ni\text{-}min}$ is the minimum concentration of Ni on the surface and $C_{Ni\text{-}Ave}$ is the average concentration of Ni on the surface.

6 Claims, 7 Drawing Sheets

(52) U.S. Cl.
CPC ..... *C21D 8/0236* (2013.01); *C21D 8/0273* (2013.01); *C22C 38/001* (2013.01); *C22C 38/02* (2013.01); *C22C 38/04* (2013.01); *C22C 38/16* (2013.01); *C21D 2211/001* (2013.01); *C21D 2211/008* (2013.01)

(58) Field of Classification Search
USPC ..... 420/61
See application file for complete search history.

(56) References Cited

FOREIGN PATENT DOCUMENTS

| | | | | |
|---|---|---|---|---|
| JP | H05-059447 | A | | 3/1993 |
| JP | H07-268455 | A | | 10/1995 |
| JP | 07292438 | A | * | 11/1995 |
| JP | H07-292438 | A | | 11/1995 |
| JP | H08-103802 | A | | 4/1996 |
| JP | H08-300124 | A | | 11/1996 |
| JP | H10-121207 | A | | 5/1998 |
| JP | 3090148 | B2 | | 9/2000 |
| JP | 2007-197821 | A | | 8/2007 |
| KR | 10-2016-0079998 | A | | 7/2016 |

OTHER PUBLICATIONS

International Search Report issued in corresponding International Patent Application No. PCT/KR2017/014086 dated Mar. 20, 2018.
Extended European Search Report dated Aug. 21, 2019 issued in European Patent Application No. 17883579.9.
Chinese Office Action dated Aug. 20, 2020 issued in Chinese Patent Application No. 201780084404.5 (with English translation.
Japanese Office Action dated Aug. 4, 2020 issued in Japanese Patent Application No. 2019-534160 (with English translation).
Indian Examination Report dated Nov. 19, 2020 issued in Indian Patent Application No. 201917024694 (with Partial English translation).

* cited by examiner

【FIG. 1】
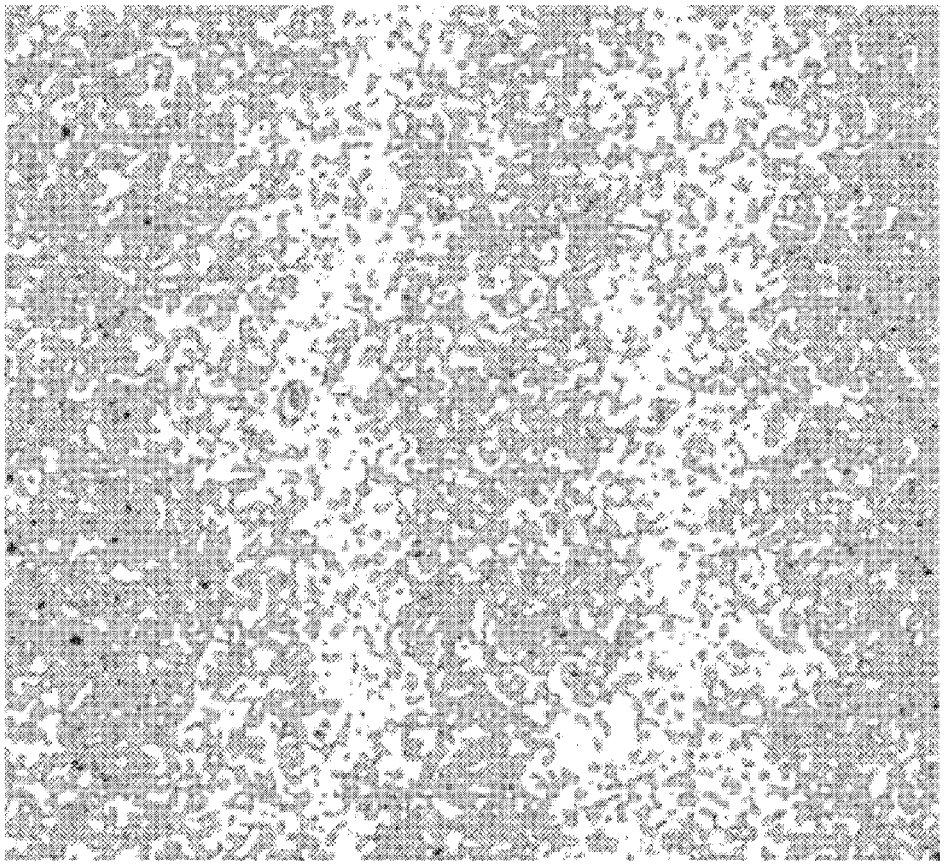

【FIG. 2】
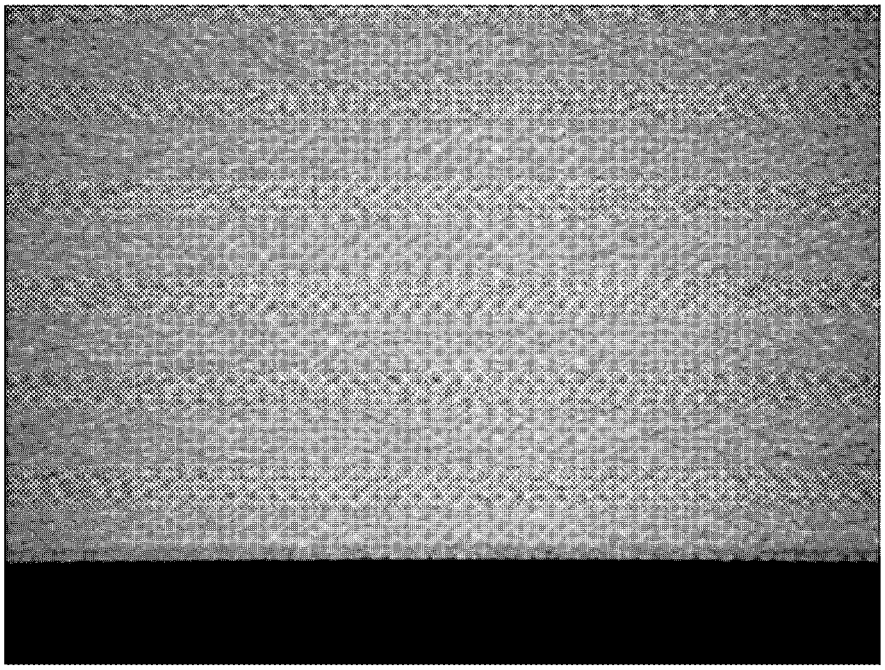

【FIG. 3】
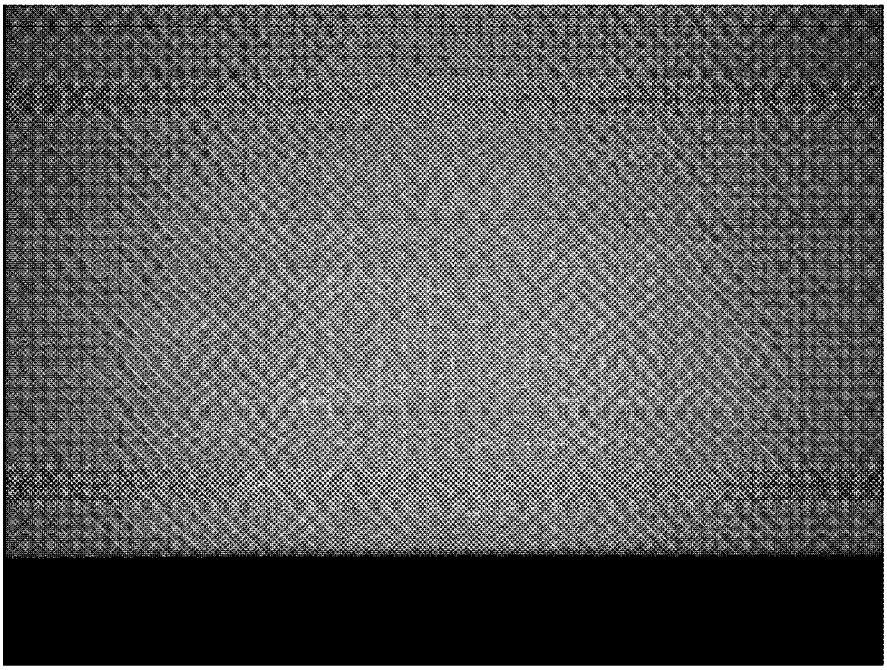

【FIG. 4】
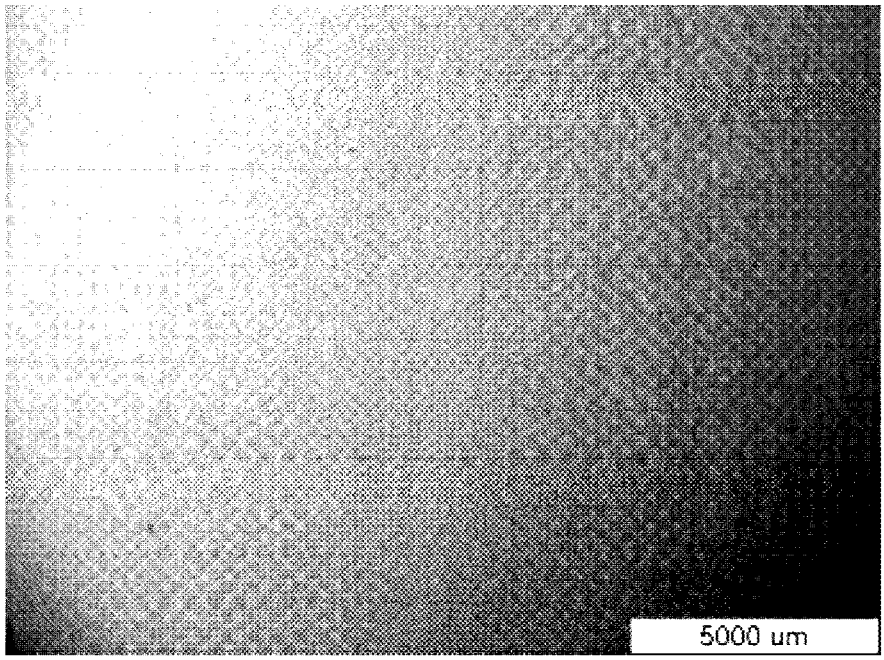

【FIG. 5】
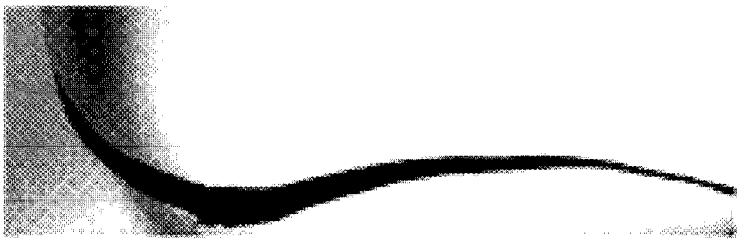

【FIG. 6】
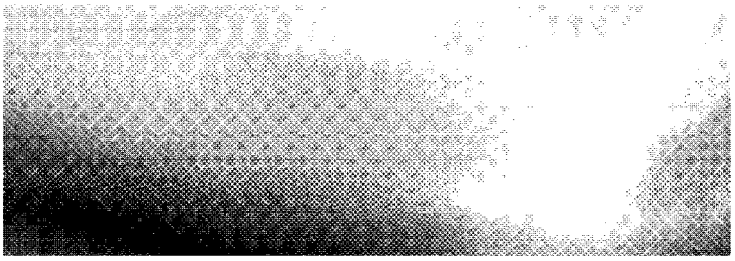

【FIG. 7】
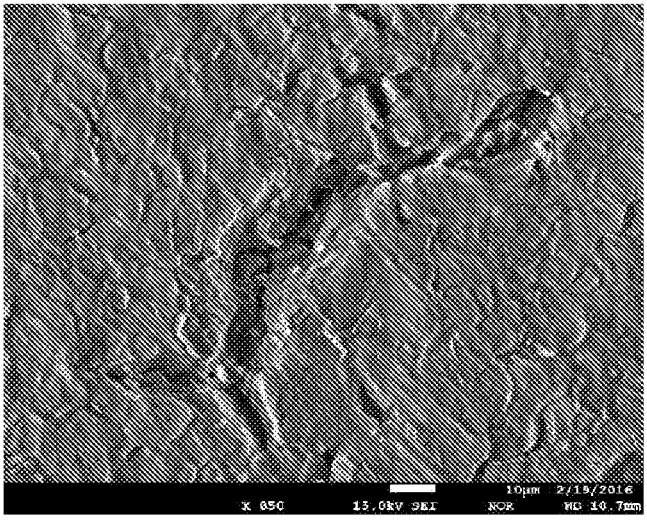
【FIG. 8】
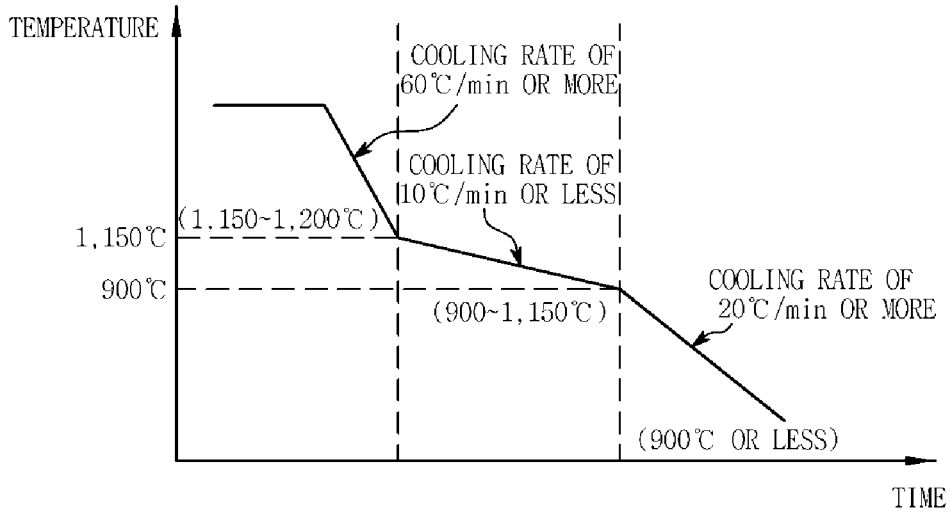

AUSTENITIC STAINLESS STEEL PRODUCT HAVING EXCELLENT SURFACE PROPERTIES AND MANUFACTURING METHOD OF THE SAME

CROSS-REFERENCE OF RELATED APPLICATIONS

This application is the U.S. National Phase under 35 U.S.C. § 371 of International Patent Application No. PCT/KR2017/014086, filed on Dec. 4, 2017, which in turn claims the benefit of Korean Patent Application No. 10-2016-0177373, filed Dec. 23, 2016, the entire disclosures of which applications are incorporated by reference herein.

TECHNICAL FIELD

The present invention relates to an austenitic stainless steel product and a manufacturing method of the same, and more specifically to an austenitic stainless steel product having excellent surface properties and a manufacturing method of the same.

BACKGROUND ART

The present invention relates to an austenitic stainless steel product used for a sink or the like, more particularly, in synchro processing, the present invention relates to an austenitic stainless steel product excellent in workability and surface properties in which defects such as cracks and surface defects such as protrusions and stripes do not occur on the surface after processing.

Stainless steel is generally used for sink bowls in kitchen sinks. Specific general purpose stainless steels are mainly used widely because there is no problem in formability when forming the shape of general sink bowls.

However, in recent years, attempts have been made to design a sink bowl of various and complex shapes in order to enhance competitiveness in the market.

In forming the austenitic stainless steel, for materials with poor workability, defects such as cracks are generated after processing. In addition, the surface properties may be poor due to the formation of protrusions on the surface after processing. When defects such as cracks are generated, the production yield is lowered due to defective processing. If the surface properties are poor, an additional process such as polishing of the surface is required, which increases the production cost.

For example, STS 304 steel is conventionally used as a steel widely used for processing such as sinks, etc., but the above-mentioned processing cracks and surface deterioration often cause permanent problems.

Korean Patent Publication No. 10-2013-0014069 (published Feb. 20, 2013)

DISCLOSURE

Technical Problem

Embodiments of the present invention are intended to provide an austenitic stainless steel product excellent in surface properties that does not cause processing cracks and surface deterioration even when processed into a complicated shape such as a sink, and a method of manufacturing the same.

Technical Solution

An austenitic stainless steel product having excellent surface properties according to one embodiment of the present invention includes, by weight percent, 0.005 to 0.15% of C, 0.1 to 1.0% of Si, 0.1 to 2.0% of Mn, 6.0 to 8.0% of Ni, 16 to 18% of Cr, 0.1 to 4.0% of Cu, 0.005 to 0.2% of N, 0.01 to 0.2% of Mo, and the remainder comprising iron (Fe) and other unavoidable impurities, and a surface degree of negative segregation of Ni defined by the following formula (1) is in the range of 0.6 to 0.9, and the martensite fraction is 10 to 30%.

$$(C_{Ni\text{-}Min})/(C_{Ni\text{-}Ave}) \qquad \text{Formula (1)}$$

Where $C_{Ni\text{-}Min}$ is the minimum concentration of Ni at the surface and $C_{Ni\text{-}Ave}$ is the average concentration of Ni at the surface.

Further, according to one embodiment of the present invention, a surface hardness ratio defined by the following formula (2) may be in the range of 1.1 to 1.6.

$$A/B \qquad \text{Formula (2)}$$

According to an embodiment of the present invention, the number of cracks having a depth of 20 μm or more from the surface may be 10 or less.

In addition, according to one embodiment of the present invention, a Ni surface segregation portion is less than 60% in area fraction, and a Ni surface negative segregation portion can be more than 5% in area fraction.

A method of manufacturing an austenitic stainless steel product having excellent surface properties according to an embodiment of the present invention, the method including: processing the austenitic stainless steel comprising, by weight percent, 0.005 to 0.15% of C, 0.1 to 1.0% of Si, 0.1 to 2.0% of Mn, 6.0 to 8.0% of Ni, 16 to 18% of Cr, 0.1 to 4.0% of Cu, 0.005 to 0.2% of N, 0.01 to 0.2% of Mo, and the remainder comprising iron (Fe) and other unavoidable impurities; and heat treating the austenitic stainless steel product at a temperature of 900-1,150° C. for 10 minutes or less; and cooling the heat-treated austenitic stainless steel product to 500° C. within 30 minutes.

Also, according to an embodiment of the present invention, before the heat treatment, the martensite fraction of the austenitic stainless steel product may be 10 to 50%.

Also, according to an embodiment of the present invention, after cooling, the martensite fraction of the austenitic stainless steel product may be 10 to 30%.

Advantageous Effects

The austenitic stainless steel product according to the embodiments of the present invention can prevent defects such as processing cracks even though it is processed into a complicated shape such as a sink or the like and prevent surface defects such as protrusions and stripes generated on the surface after processing.

DESCRIPTION OF DRAWINGS

FIG. 1 is a photograph obtained by photographing a Ni segregation portion and a negative segregation portion formed on a surface of an austenitic stainless steel product according to an embodiment of the present invention.

FIG. 2 is a photograph obtained by photographing a surface of a conventional austenitic stainless steel product.

FIG. 3 is a photograph obtained by photographing a surface of an austenitic stainless steel product according to an embodiment of the present invention.

FIG. 4 is a photograph obtained by photographing a surface of an austenitic stainless steel product according to a comparative example of the present invention.

FIG. 5 is a photograph obtained by photographing a processed surface of a product processed using a conventional austenitic stainless steel.

FIG. 6 is a photograph obtained by photographing a processed surface of a product processed using an austenitic stainless steel according to an embodiment of the present invention.

FIG. 7 is a photograph obtained by photographing surface cracks of an austenitic stainless steel product according to a comparative example of the present invention.

FIG. 8 is a graph for describing a method of manufacturing an austenitic stainless steel according to an embodiment of the present invention.

MODES OF THE INVENTION

Hereinafter, the embodiments of the present disclosure will be described in detail with reference to the accompanying drawings. The following embodiments are provided to transfer the technical concepts of the present disclosure to one of ordinary skill in the art. However, the present disclosure is not limited to these embodiments, and may be embodied in another form. In the drawings, parts that are irrelevant to the descriptions may not be shown in order to clarify the present disclosure, and also, for easy understanding, the sizes of components are more or less exaggeratedly shown.

An austenitic stainless steel product having excellent surface properties according to one embodiment of the present invention includes, by weight percent, 0.005 to 0.15% of C, 0.1 to 1.0% of Si, 0.1 to 2.0% of Mn, 6.0 to 8.0 of Ni, 6 to 18% of Cr, 0.1 to 4.0% of Cu, 0.005 to 0.2% of N, 0.01 to 0.2% of Mo, and the remainder comprising iron (Fe) and other unavoidable impurities.

That is, the product may be manufactured by processing the stainless steel, and the product may be, for example, a sink bowl.

Hereinafter, a reason for the numerical limitation of element contents constituting the austenitic stainless steel excellent in workability and surface properties of the present invention will be described C is added by controlling the amount within the range of 0.005 to 0.15 wt %.

C is an austenite phase stabilizing element, and when C is added in a large amount, the austenite phase is stabilized, so it is contained in an amount of 0.005% or more. However, when C is excessively added, the strength is too high and it may be difficult to process.

Si is added by controlling the amount within the range of 0.1 to 1.0 wt %.

As Si is added, it provides a certain level of work hardening and corrosion resistance, so it is contained in an amount of 0.1% or more. However, if it is excessively added, toughness may be inhibited, so it is limited to 1.0% or less.

Mn is added by controlling the amount within the range of 0.1 to 2.0 wt %.

Mn is an austenite phase stabilizing element, and the more Mn is added, the more stabilized the austenite phase and the lower the work hardening rate, so it is contained in an amount of 0.1% or more. However, if it is added excessively, corrosion resistance is deteriorated, so it is limited to 2.0% or less.

Ni is added by controlling the amount within the range of 6.0 to 8.0 wt %.

Ni is an austenite phase stabilizing element, and as the amount of Ni is increased, the more stabilized the austenite phase. When the amount of Ni is increased, the rate of nitrocarburizing and work hardening of the austenite steel is reduced. In the present invention, Ni is an element that forms a segregation zone, so it is added in an amount of 6.0% or more. However, the addition of a large amount increases the cost, so it is limited to 8.0%.

Cr is added by controlling the amount within the range of 16 to 18 wt %.

Cr is an element for improving corrosion resistance, and it is added in an amount of 16% or more, but excessive addition is accompanied by an increase in cost, so it is limited to 18%.

Cu is added by controlling the amount within the range of 0.1 to 4.0 wt %.

Cu is an austenite phase stabilizing element, and the more the addition, the more stabilized the austenite phase, and the nitrocarburizing and the work hardening speed of the austenite steel are reduced, so it is contained in an amount of 0.1%. As the amount of Cu added increases, the more stabilized the austenite phase and the properties pursued by the present invention are obtained, thus it is possible to be added up to 4.0%. However, excessive addition of Cu is accompanied by an increase in cost, so it is preferable to limit the Cu content to 2.0%.

N is added by controlling the amount within the range of 0.005 to 0.2% wt %.

N is an austenite phase stabilizing element, and the more the addition, the more stabilized the austenite phase and the more improve the corrosion resistance, so it is contained in an amount of 0.005% or more. However, if it is excessively added, the strength becomes too high and it may be difficult to process. Therefore, it should be limited to 0.2% or less.

Mo is added by adjusting the amount within the range of 0.01 to 0.2 wt %.

Since Mo improves corrosion resistance and workability, it is contained in an amount of 0.01% or more, but excessive addition is accompanied by an increase in cost, so it is limited to 0.2% or less.

FIG. 1 is a photograph obtained by photographing a Ni segregation portion and a Ni negative segregation portion formed on a surface of an austenitic stainless steel product according to an embodiment of the present invention.

FIG. 2 is a photograph obtained by photographing a surface of a conventional austenitic stainless steel product.

FIG. 3 is a photograph obtained by photographing a surface of an austenitic stainless steel product according to an embodiment of the present invention.

Referring to FIG. 1, the austenitic stainless steel product excellent in workability and surface properties according to an embodiment of the present invention includes a Ni surface segregation portion and a Ni surface negative segregation portion on a steel surface.

That is, the austenitic stainless steel product according to one embodiment of the present invention has a Ni surface negative segregation degree of 0.6 to 0.9 defined by the following formula (1).

$$(C_{Ni\text{-}Min})/(C_{Ni\text{-}Ave}) \qquad \text{Formula (1)}$$

Where $C_{Ni\text{-}Min}$ is the minimum concentration of Ni at the surface and $C_{Ni\text{-}Ave}$ is the average concentration of Ni at the surface.

A surface degree of negative segregation of Ni is defined by formula (1) and is a value obtained by dividing the minimum concentration of Ni on the surface of the steel by the average concentration of Ni, and the minimum concentration of Ni is a value measured in the Ni negative segregation portion.

Here, the segregation degree is measured on the surface of the stainless steel product. In order to have statistical significance, it is preferable to measure the area at 500*500 $\mu m^2$ or more and measure at more than 50 positions at regular intervals on each axis.

The measurement method may be performed by energy dispersive spectroscopy (EDS) or electron probe micro analysis (EPMA).

In the present invention, the elemental distribution of Ni was measured using EPMA on the surface of the stainless steel in the area of 800*800 $\mu m^2$, which is shown in FIG. 1.

In FIG. 1, the bright color indicates the Ni negative segregation portion, and the dark color indicates the Ni segregation portion, indicating that the segregation zone is formed.

Referring to FIG. 2, FIG. 2 is a photograph obtained by photographing a surface of an STS 301 steel product using conventional austenitic stainless steel. This shows that the surface of the austenitic stainless steel product has no Ni segregation portion and no negative segregation portion formed therein, and the surface of the product has protrusions, which degrades the surface properties due to surface roughness.

Alternately, referring to FIG. 3, FIG. 3 is a photograph of a surface of an austenitic stainless steel product according to an embodiment of the present invention. This shows that the Ni surface segregation portion and the Ni surface negative segregation portion are formed on the surface of the austenitic stainless steel product, so that no stripes or protrusions are generated on the surface even when processed, and the surface quality is good.

The present inventors presume that when the stainless steel having the Ni surface segregation portion is processed, a large amount of martensitic transformation occurs in a negative segregation portion during processing, and the formation of protrusions is suppressed as compared with a material containing the same amount of Ni but not forming a segregation portion.

FIG. 4 is a photograph obtained by photographing a surface of an austenitic stainless steel product according to a comparative example of the present invention.

When the surface degree of negative segregation of the Ni is less than 0.6, there is a problem that the segregation zone is excessively formed on the surface, and severe stripes appear along the rolling direction on the surface after processing. Referring to FIG. 4, FIG. 4 is a photograph obtained by photographing a surface of an austenitic stainless steel having a surface degree of negative segregation of Ni of 0.5. It can be seen that stripes are observed in the rolling direction, and surface defects due to such stripes increase the production cost by requiring additional processes such as polishing of the surface, etc.

In addition, when the surface degree of negative segregation of Ni is more than 0.9, the segregation portion and the negative segregation portion for the purpose of the present invention are not formed or the formation amount thereof is small, and martensitic transformation at the negative segregation portion does not occur.

Further, the martensite fraction of the austenitic stainless steel product according to an embodiment of the present invention is 10 to 30%.

If the martensite fraction of the product exceeds 30%, there is a problem that cracks occur during further processing, and if the martensite fraction of the product is in the range of 10 to 30%, no cracks or wrinkles occur on the surface even during further processing.

For example, the Ni surface segregation portion of the austenitic stainless steel product may be less than 60% in area fraction, and the Ni surface negative segregation portion may be more than 5% in area fraction.

The Ni surface segregation portion is a Ni enriched region having a higher Ni concentration than the average concentration of Ni on the surface, and the Ni surface negative segregation portion is a Ni depletion region having a lower Ni concentration than the average concentration of Ni on the surface. For example, the Ni enriched region may have a Ni concentration of 1.2 times or more than the average Ni concentration at the surface, and the Ni depletion region may have a Ni concentration of 0.8 times or less than the average concentration of Ni at the surface.

When the Ni surface negative segregation portion is formed in an area fraction of 5% or less on the surface of the austenitic stainless steel or the Ni surface segregation portion is formed in an area fraction of 60% or more, martensitic transformation is not sufficiently performed in the negative segregation portion, and it is difficult to suppress the generation of protrusions on the surface after processing.

For example, the Ni surface negative segregation portion may include at least 60% of segregation having a major diameter of 100 μm or less. Accordingly, as the segregation in the Ni surface negative segregation portion is miniaturized, it is possible to prevent the occurrence of stripes along the rolling direction on the surface after processing as the segregation size increases, and the surface properties can be improved.

For example, the austenitic stainless steel product according to an embodiment of the present invention may have a surface hardness ratio defined by the following formula (2) in the range of 1.1 to 1.6.

$$A/B \qquad \text{Formula (2)}$$

Here, A is an average value of the upper 10% of the product surface hardness, and B is an average value of the lower 10% of the product surface hardness.

In measuring the surface hardness, it is preferable to measure at more than 50 positions in the range of 10 mm per direction in the cross direction in order to have statistical significance. For example, the value obtained by dividing the average value of the top five of the surface hardness by the average value of the bottom five may be the surface hardness ratio.

If the surface hardness ratio is less than 1.1, the segregation portion and the negative segregation portion are not formed on the surface of the product, or the formation amount thereof is small, and the amount of martensite transformation in the negative segregation portion is relatively small, Accordingly, there are protrusions on the surface of the stainless steel product, and there is a problem that wrinkles are generated on the surface during further processing.

When the surface hardness ratio exceeds 1.6, segregation zone are excessively formed on the surface of the product, and severe stripes appear along the rolling direction of the austenitic stainless steel on the surface of the product, resulting in cracks in further processing.

FIG. 5 is a photograph obtained by photographing a processed surface of a product processed using a conventional austenitic stainless steel.

FIG. 6 is a photograph obtained by photographing a processed surface of a product processed using an austenitic stainless steel according to an embodiment of the present invention.

FIG. 7 is a photograph obtained by photographing surface cracks of an austenitic stainless steel product according to a comparative example of the present invention.

For example, the austenitic stainless steel product according to an embodiment of the present invention may have ten or less cracks having a depth of 20 μm or more from the surface. If the number of cracks having a depth of 20 μm or more from the surface of the product exceeds 10, the product may be judged to be defective and its use may be restricted.

Referring to FIGS. 5 and 7, the surface of the STS 301 steel product, a product using conventional austenitic stainless steel, was observed, and it can be seen that the surface crack is severely generated during the processing of the austenitic stainless steel. Therefore, it can be seen that the austenitic stainless steel product of the present invention exhibits good sink workability as shown in example 6.

A method of manufacturing the austenitic stainless steel product having excellent surface properties according to an embodiment of the present invention, the method comprising: processing the austenitic stainless steel comprising, by weight percent, 0.005 to 0.15% of C, 0.1 to 1.0% of Si, 0.1 to 2.0% of Mn, 6.0 to 8.0% of Ni, 16 to 18% of Cr, 0.1 to 4.0% of Cu, 0.005 to 0.2% of N, 0.01 to 0.2% Mo, and the remainder comprising iron (Fe) and other unavoidable impurities; and heat treating the austenitic stainless steel product at a temperature of 900-1,150° C. for 10 minutes or less; and cooling the heat-treated austenitic stainless steel product to 500° C. within 30 minutes.

FIG. 8 is a graph for describing a method of manufacturing an austenitic stainless steel according to an embodiment of the present invention.

Referring to FIG. 8, the austenitic stainless steel comprising, by weight percent, 0.005 to 0.15% of C, 0.1 to 1.0% of Si, 0.1 to 2.0% of Mn, 6.0 to 8.0% of Ni, 16 to 18% of Cr, 0.1 to 4.0% of Cu, 0.005 to 0.2% of N, 0.01 to 0.2% of Mo, and the remainder comprising iron (Fe) and other unavoidable impurities may be manufactured by continuously casting the austenitic stainless steel.

At this time, the continuous casting step includes cooling a slab at a rate of 60° C./min or more at a first temperature section of 1,150 to 1,200° C. in a secondary cooling zone, cooling the slab at a rate of 10° C./min or less at a second temperature section of 900 to 1,150° C., and cooling the slab at a rate of 20° C./min or more at a third temperature section of 900° C. or less.

The continuously cast slab is subjected to a step of cooling the slab at a rate of 60° C./min or more in the first temperature section of 1,150 to 1,200° C.

The slab is manufactured by continuous casting from molten steel having the component system of the present invention. At this time, in order to form the Ni surface segregation portion and the Ni surface negative segregation portion on the surface of the slab, the slab is quenched in the first temperature section. At this time, for example, the entire surface of the slab is cooled at a high speed through front nozzle injection. Alternatively, when the slab is cooled at a rate less than 60° C./min in the first temperature section, the Ni surface segregation portion and the negative segregation portion may not be formed on the surface.

Normally, Ni segregation due to continuous casting is known as center segregation of slabs, however, when quenching is performed at a constant temperature range as in the present invention, the Ni segregation may be formed on the slab surface.

Accordingly, the austenitic stainless steel according to one embodiment of the present invention can satisfy the surface degree of negative segregation of Ni represented by formula (1) in the range of 0.6 to 0.9.

Thereafter, the slab is cooled at a rate of 10° C./min or less at a second temperature range of 900 to 1,150° C.

After the Ni segregation is formed on the surface in the first temperature section, the slab is slowly cooled in the second temperature section. Accordingly, a part of the Ni segregation on the slab surface is solid-solubilized again.

Accordingly, the Ni surface segregation portion of the austenitic stainless steel is less than 60% in area fraction, and the Ni surface negative segregation portion can satisfy an area fraction of more than 5%.

Thereafter, the slab is cooled at a rate of 20° C./min or more at a third temperature range of 900° C. or lower.

After part of the Ni segregation is solid-solubilized again on the surface in the second temperature section, the slab is quenched in the third temperature section. Accordingly, the segregation can be made fine in the negative surface portion of the Ni surface on the slab surface.

Thereafter, the slab cooled in the second cooling step is hot-rolled and the hot-rolled slab is cold-rolled.

At this time, during the hot-rolling, reheating of the continuously cast austenitic stainless steel slab is performed within 5 hours. When the reheating time of the slab exceeds 5 hours, the Ni surface segregation portion and the negative segregation portion formed on the surface start to be decomposed, and the Ni surface negative segregation portion and the Ni surface segregation ratio for the purpose of the present invention cannot be satisfied Further, when hot-rolling annealing or cold-rolling annealing, the temperature is elevated to an annealing temperature of 1,000 to 1,200° C. within 30 seconds, and then the holding time is performed within 30 seconds. As the temperature rise time and the holding time increase in hot-rolled annealing or cold-rolled annealing, the Ni surface segregation portion and the negative segregation portion formed on the surface start to decompose, and the Ni surface negative segregation portion and the Ni surface segregation ratio of the surface for the purpose of the present invention cannot be satisfied.

After processing the austenitic stainless steel, the austenitic stainless steel product is heat-treated at a temperature of 900 to 1,150° C. for 10 minutes or less. In order to control the surface segregation zone, hardness ratio, and martensite fraction of the product, the heat treatment process of the product is performed.

For example, the martensite fraction of the austenitic stainless steel product before the heat treatment may be 10 to 50%.

The heat treatment is performed at a temperature of 900 to 1,150° C. for 10 minutes or less. When the heat treatment temperature is less than 900° C., it is difficult to reduce the fraction of deformation induced martensite. If the heat treatment temperature is more than 1,150° C. or the heat treatment time is more than 10 minutes, the Ni surface segregation portion and the negative segregation portion formed on the surface start to be decomposed and the Ni surface degree of negative segregation and the surface hardness ratio of the surface for the purpose of the present invention cannot be satisfied.

Thereafter, the heat-treated austenitic stainless steel product is cooled to 500° C. within 30 minutes. In order to miniaturize the segregation in the negative segregation portion of the Ni surface of the product, a quenching process of the product is performed.

The austenitic stainless steel product can be cooled by air cooling or water cooling so that the segregation can be miniaturized in the negative surface portion of the product surface.

For example, the Ni surface negative segregation portion may include at least 60% of the segregation having a major diameter of 100 μm or less. Accordingly, as the segregation in the Ni surface negative segregation portion is miniaturized, it is possible to prevent the occurrence of stripes on the surface after the additional processing as the segregation size increases, and the surface properties can be improved.

For example, after cooling, the martensite fraction of the austenitic stainless steel product may be 10 to 30%.

Hereinafter, the present invention will be described in more detail with reference to examples.

EXAMPLE

Austenitic stainless steel slabs containing the components of inventive examples 1 to 9 and comparative examples 1 to 6 of Table 1 below were continuously cast. Thereafter, the steel sheet was subjected to hot-rolling and cold-rolling at a total reduction ratio of 50% to manufacture cold-rolled steel sheets.

Thereafter, the cold-rolled steel sheets of inventive examples 1 to 9 and comparative examples 1 to 6 were processed to have a martensite content of 40% by using a spherical punch having a diameter of 150 mm. When the temperature of a product reached 1,100° C., it was heat treated for 30 seconds and then cooled by air cooling to 500° C. for 2 minutes. After that, the workability was observed after further processing.

TABLE 1

| | C | Si | Mn | Ni | Cr | Cu | Mo | N |
|---|---|---|---|---|---|---|---|---|
| Inventive example 1 | 0.115 | 0.6 | 0.2 | 6.8 | 17.3 | 0.61 | 0.19 | 0.05 |
| Inventive example 2 | 0.109 | 0.6 | 0.8 | 6.7 | 17.2 | 0.59 | 0.14 | 0.05 |
| Inventive example 3 | 0.108 | 0.2 | 1.6 | 6.7 | 17.2 | 1.00 | 0.09 | 0.05 |
| Inventive example 4 | 0.108 | 0.9 | 1.9 | 6.7 | 16.2 | 1.60 | 0.09 | 0.05 |
| Inventive example 5 | 0.108 | 0.6 | 0.9 | 9.8 | 19.6 | 1.00 | 0.09 | 0.05 |
| Inventive example 6 | 0.108 | 0.6 | 1.0 | 6.6 | 17.2 | 0.12 | 0.04 | 0.04 |
| Inventive example 7 | 0.009 | 0.6 | 0.9 | 6.6 | 17.2 | 2.05 | 0.04 | 0.14 |
| Inventive example 8 | 0.115 | 0.6 | 0.9 | 6.6 | 17.2 | 2.94 | 0.04 | 0.04 |
| Inventive example 9 | 0.115 | 0.6 | 0.9 | 6.1 | 17.2 | 3.90 | 0.01 | 0.04 |
| Comparative example 1 | 0.110 | 0.6 | 0.9 | 6.7 | 17.0 | 0.25 | 0.12 | 0.04 |
| Comparative example 2 | 0.113 | 0.6 | 0.9 | 6.7 | 17.2 | 0.00 | 0.04 | 0.04 |
| Comparative example 3 | 0.110 | 0.6 | 0.8 | 6.6 | 17.2 | 0.05 | 0.04 | 0.04 |
| Comparative example 4 | 0.115 | 0.6 | 0.9 | 5.8 | 17.2 | 1.00 | 0.01 | 0.04 |
| Comparative example 5 | 0.111 | 0.6 | 0.9 | 7.0 | 18.0 | 0.01 | 0.04 | 0.04 |
| Comparative example 6 | 0.060 | 0.6 | 0.9 | 8.5 | 19.2 | 0.01 | 0.01 | 0.04 |

The degree of negative segregation, martensite fraction, surface hardness ratio, surface properties, and cracks or wrinkles after further processing of the product thus prepared were observed with naked eyes, and the results are shown in Table 2 below.

TABLE 2

| | Surface degree of negative segregation of Ni | Martensite fraction(%) | Surface hardness ratio | Surface properties | Workability |
|---|---|---|---|---|---|
| Inventive example 1 | 0.90 | 19.0 | 1.2 | good | good |
| Inventive example 2 | 0.67 | 23.0 | 1.5 | good | good |
| Inventive example 3 | 0.90 | 21.0 | 1.1 | good | good |
| Inventive example 4 | 0.63 | 15.0 | 1.5 | good | good |
| Inventive example 5 | 0.71 | 10.0 | 1.4 | good | good |
| Inventive example 6 | 0.67 | 28.0 | 1.5 | good | good |
| Inventive example 7 | 0.83 | 18.0 | 1.2 | good | good |
| Inventive example 8 | 0.90 | 13.0 | 1.2 | good | good |
| Inventive example 9 | 0.90 | 14.0 | 1.1 | good | good |
| Comparative example 1 | 0.53 | 35.0 | 2.2 | stripes | cracks |
| Comparative example 2 | 0.59 | 32.0 | 1.7 | stripes | cracks |
| Comparative example 3 | 0.56 | 40.0 | 1.9 | stripes | cracks |
| Comparative example 4 | 0.45 | 45.0 | 2.2 | stripes | cracks |
| Comparative example 5 | 1.00 | 16.0 | 1.0 | protrusions | wrinkles |
| Comparative example 6 | 1.00 | 15.0 | 1.0 | protrusions | wrinkles |

Here, the Ni surface degree of the negative segregation and the surface hardness ratio are measured on the surface of the austenitic stainless steel product.

In order to have statistical significance, it is preferable to measure at an area of 500*500 $\mu m^2$ or more and measure at 50 or more positions at equal intervals on each axis The measurement surface may be a circular surface or a polished surface. When polishing is performed, the particle size of a polishing agent is preferably 2 μm or less. The measurement method can be performed by energy dispersive spectroscopy (EDS) or electron probe micro analysis (EPMA).

In the present invention, the elemental distribution of Ni was photographed by an EPMA method at an area of 800 μm*800 μm. Since stainless steels typically form an oxide layer on the surface, when the reaction volume is not sufficient enough to allow a device for measurement of elements to measure an area below the oxide layer, the oxide layer is measured on the polished surface of 1 to 200 μm from the surface. Also, foreign matter was irrelevant in the present invention and Ni segregation was measured for stainless steel under the oxide layer.

Referring to Tables 1 and 2, when the composition and range of the austenitic stainless steel product according to an embodiment of the present invention are satisfied, it can be seen that the surface properties and workability are excellent.

However, even if these compositional ranges are satisfied, it can be seen that the surface properties and workability are disadvantageous when the Ni degree of negative segregation defined by the formula (1) and the surface hardness ratio defined by the formula (2) of the steel surface are not satisfied.

In addition, the results of observing the number of cracks having a depth of 20 μm or more from the surface after further processing of inventive examples 1 to 3 and comparative examples 1 to 3 are shown in Table 3 below.

TABLE 3

| | Number of cracks during further processing (ea) |
|---|---|
| Inventive example 1 | 1 |
| Inventive example 2 | 2 |
| Inventive example 3 | 8 |
| Comparative example 1 | 15 |
| Comparative example 2 | 50 |
| Comparative example 3 | 20 |

Referring to Table 3, it can be seen that the workability is good when the number of cracks having a depth of 20 μm or more from the surface during the further processing of the austenitic stainless steel product according to the embodiments of the present invention is 10 or less, and according to the comparative examples, it can be seen that the number of cracks having a depth of 20 μm or more from the surface exceeds 10, resulting in a large amount, and the workability is inferior.

While the present disclosure has been particularly described with reference to exemplary embodiments, it should be understood by those of skilled in the art that various changes in form and details may be made without departing from the spirit and scope of the present disclosure.

The invention claimed is:

1. An austenitic stainless steel product, the stainless steel comprising:

by weight percent, 0.005 to 0.15% of C, 0.1 to 1.0% of Si, 0.1 to 2.0% of Mn, 6.0 to 8.0% of Ni, 16 to 18% of Cr, 0.1 to 4.0% of Cu, 0.005 to 0.2% of N, 0.01 to 0.2% of Mo, and the remainder comprising iron (Fe) and other unavoidable impurities, and a surface degree of negative segregation of Ni defined by the following formula (1) is in the range of 0.6 to 0.9 and the martensite fraction thereof is 10 to 30%

(CNi-Min)/(CNi-Ave) Formula (1)

Where CNi-Min is the minimum concentration of Ni at the surface and CNi-Ave is the average concentration of Ni at the surface, and wherein a surface hardness ratio defined by the following formula (2) is in the range of 1.1 to 1.6

A/B Formula (2)

where A is the average value of the upper 10% of the product surface hardness, and B is the average value of the lower 10% the product surface hardness.

2. The austenitic stainless steel product according to claim 1, wherein cracks having a depth of 20 μm or more from the surface is 10 or less.

3. The austenitic stainless steel product according to claim 1, wherein a Ni surface segregation portion is less than 60% in area fraction and a Ni surface negative segregation portion is more than 5%.

4. A method of manufacturing an austenitic stainless steel product, the method comprising:

processing the austenitic stainless steel product, comprising:

by weight percent, 0.005 to 0.15% of C, 0.1 to 1.0% of Si, 0.1 to 2.0% of Mn, 6.0 to 8.0% of Ni, 16 to 18% of Cr, 0.1 to 4.0% of Cu, 0.005 to 0.2% of N, 0.01 to 0.2% of Mo, and the remainder comprising iron (Fe) and other unavoidable impurities; and heat treating the austenitic stainless steel product at a temperature of 900-1,150° C. for 10 minutes or less; and cooling the heat-treated austenitic stainless steel to 500° C. within 30 minutes;

wherein the austenitic stainless steel product has a surface degree of negative segregation of Ni defined by the following formula (1) is in the range of 0.6 to 0.9 and the martensite fraction thereof is 10 to 30%

(CNi-Min)/(CNi-Ave) Formula (1)

Where CNi-Min is the minimum concentration of Ni at the surface and CNi-Ave is the average concentration of Ni at the surface, and wherein a surface hardness ratio defined by the following formula (2) is in the range of 1.1 to 1.6

A/B Formula (2)

where A is the average value of the upper 10% of the product surface hardness, and B is the average value of the lower 10% the product surface hardness.

5. The method of claim 4, wherein the martensite fraction of the austenitic stainless steel product before the heat treatment is 10 to 50%.

6. The method of claim 5, wherein the martensite fraction of the austenitic stainless steel product after cooling is 10 to 30%.

* * * * *